United States Patent [19]

Dykstra

[11] Patent Number: 5,040,797

[45] Date of Patent: Aug. 20, 1991

[54] BLOCK PUZZLE

[76] Inventor: Dirk H. Dykstra, Box 7168, Nikishi, Ak. 99635

[21] Appl. No.: 143,952

[22] Filed: Jan. 14, 1988

[51] Int. Cl.[5] ..... A63F 9/12

[52] U.S. Cl. ..... 273/160

[58] Field of Search ..... 273/160

[56] References Cited

U.S. PATENT DOCUMENTS

| | | | |
|---|---|---|---|
| 430,502 | 6/1890 | Altekruse | 273/160 |
| 767,645 | 8/1904 | Kelly | 273/160 |
| 781,050 | 1/1905 | Curtis | 273/160 |
| 906,450 | 12/1908 | Murf et al. | 273/160 |
| 943,496 | 12/1909 | Weigt | 273/160 |
| 1,225,760 | 5/1917 | Brown | 273/160 |
| 1,261,242 | 4/1918 | Keiser | 273/160 |
| 1,350,039 | 8/1920 | Senyk | 273/160 |
| 1,388,710 | 8/1921 | Hime | 273/160 |
| 1,425,107 | 8/1922 | Levinson | 273/160 |
| 1,455,009 | 5/1923 | Schenk | 273/160 |
| 2,473,369 | 6/1949 | Harris | 273/160 |
| 2,836,421 | 5/1958 | Turner | 273/160 |
| 3,372,936 | 3/1968 | Sanson | 273/160 |
| 3,638,949 | 2/1972 | Thompson | 273/160 X |
| 3,721,448 | 3/1973 | Coffin | 273/160 |
| 4,148,489 | 4/1979 | Pidgeon | 273/160 |
| 4,534,563 | 8/1985 | Guenther | 273/160 X |

OTHER PUBLICATIONS

"Puzzles Old & New", by J. Slocum & J. Botermans, copyright 1986, publ. by Plenary Publications Int., The Netherlands, p. 9.

Journal of Recreational Mathematics, vol. 10(4), 1977–78, copyright 1978, Article entitled "The Six--Piece Burr", by William H. Cutler, pp. 241–250.

Puzzles Old and New by Jerry Slocum, pp. 82, 83 and 154, (1986).

Puzzles in Wood by E. M. Wyatt, (1956).

*Primary Examiner*—Edward M. Coven

*Assistant Examiner*—Sebastiano Passaniti

*Attorney, Agent, or Firm*—William D. Hall

[57] ABSTRACT

A three-dimensional geometric puzzle comprised of elongated members, each having a rectangular cross-sectional shape. The members are arranged in pairs in side-by-side abutting relationship. In addition, each pair of members intersects the other pairs perpendicularly and substantially at its midpoint, thus forming a star-shaped configuration. The members can be assembled to and disassembled from the star-shape configuration in a number of predetermined order.

5 Claims, 3 Drawing Sheets

BLOCK PUZZLE

BACKGROUND OF THE INVENTION

The present invention relates to puzzles, and more particularly, to three-dimensional puzzles containing a number of parts which fit together with mortised joints.

Three-dimensional geometric puzzles have long been known and enjoyed as a challenge of one's wits. These devices provide a problem in the form of a puzzle which requires ingenuity of thought for the puzzler to arrive at the correct solution. A typical "burr" puzzle is comprised of a plurality of rectangular blocks, notched and mortised, which are assembled through the interlocking of grooves and cavities to form a three-dimensional figure. Such puzzles are typically comprised of a plurality of pieces having a wide variety of sizes, shapes and notches. These pieces will fit together in a single predescribed manner and thereby interlock to form the desired geometric figure.

These puzzles, therefore, suffer the limitations of having a single configuration wherein all of the members interlock in a single predefined pattern to form the single predescribed three-dimensional geometric figure. Some prior devices, such as the puzzle taught in Turner #2,836,421, suggest the use of extra pieces to enable the puzzle solver to form a wider variety of geometric shapes. Even given the teachings of Turner, the pieces must still fit together in a predescribed manner because of the unique notching of each member. Therefore, while the supplying of extra pieces allows for new geometric figures, the new geometric figures are inherently limited by configuration of the extra substituted pieces.

SUMMARY OF THE INVENTION

It is an object of the present invention to provide a plurality of inter-engageable rectangular bars which can be assembled into two distinct three-dimensional geometric figures in a variety of ways.

Another object of the present invention is to provide a block puzzle comprising six interengageable rectangular bars of identical length comprised of two sets of three identically-notched bars each.

It is a further object of the present invention to provide a block puzzle comprised of two sets of pieces, the pieces of the second set being configured as the mirror image of the pieces of the first set.

It is another object of the present invention to provide a puzzle which requires the solver of the puzzle first to think creatively in a first plane, and then to think in the reverse or mirror image plane.

It is yet another object of the present invention to provide a puzzle wherein the solver of the puzzle must have the requisite manual dexterity to coordinate and articulate numerous puzzle pieces simultaneously, in order to solve and assemble the puzzle.

It is still another object of the present invention to provide a wood burr puzzle having a double cross, double key, thereby providing an enhanced conceptual difficulty and presenting a greater challenge to the puzzle-solver.

It is still, yet, another object of the present invention to provide a wood burr puzzle comprised of two halves, each half presenting the mirror image of the other.

It is yet, still, another object of the present invention to provide a multipiece burr-type puzzle which can be comprised of any number of pieces wherein half of the pieces comprising the puzzle are mirror image of the other half of the pieces.

The puzzle, according to an embodiment of the present invention, is comprised of six elongated members having a square cross-section. Each member contains a central notch in one surface of the member, and a second off-centered notch in a second surface perpendicular to the first notch.

In order to assemble the puzzle, the assembler must position a first piece within the central notch of a second piece. A third piece is then utilized to interlock the two pieces by engagement of the first piece in the off-center notch of said third piece and engagement of the second piece in the central notch of the first piece. These three pieces then form one half of the final geometrical figure.

A second mirror image half is then formed in a similar manner from the remaining three puzzle pieces. The two halves are then interengaged by the sliding of the third member of each half into the groove formed by the first and second members of the other half. In this manner, a puzzle is taught, wherein the assembly is comprised of two mirror image halves, thereby providing a double key interlock utilizing a double cross. The puzzle of the present invention is, therefore, distinguished from prior puzzles in that it is not built up one piece at a time with a final key piece interlocking the entire puzzle. The puzzle is, instead, built in two mirror image halves, which simultaneously interlock to form the integral whole.

In an alternative assembly embodiment, off-center notches are utilized for engagement, instead of the central notches, to form an alternative three-dimensional final configuration. By utilization of off-center notches in place of central notches during assembly of the two mirror image halves, an alternative symmetrical, yet irregular, three-dimensional burr is formed.

In yet another alternative embodiment, a number of ancillary puzzle pieces are added to form a more multifaceted final three-dimensional figure. These auxiliary pieces are added during the intermediate assembly stages, and comprise portions of the two mirror image symmetrical halves which are united to form the final three-dimensional configuration. The augmented puzzle still follows the inventive teachings of the present invention, through utilization of a plurality of symmetrical mirror image parts, to form the double key/double cross burr, as taught herein.

BRIEF DESCRIPTION OF THE DRAWINGS

A better understanding of the puzzle according to the present invention will be obtained through a reference to the following detailed description, when taken in conjunction with the accompanying drawings, wherein like reference characters refer to like parts throughout the several views, and in which.

DETAILED DESCRIPTION OF THE PREFERRED EXEMPLARY EMBODIMENTS

Figure 1:
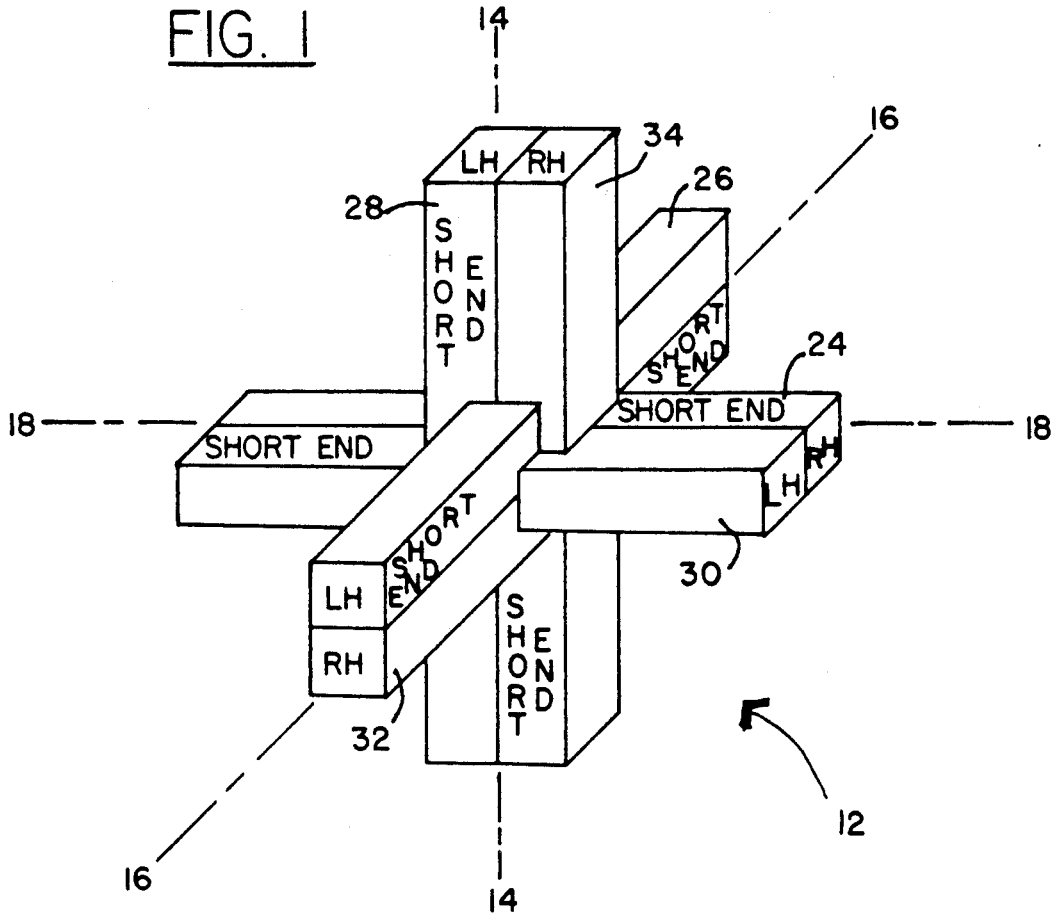
FIG. 1 is a perspective view illustrating the puzzle of the present invention, assembled.
Figure 2:
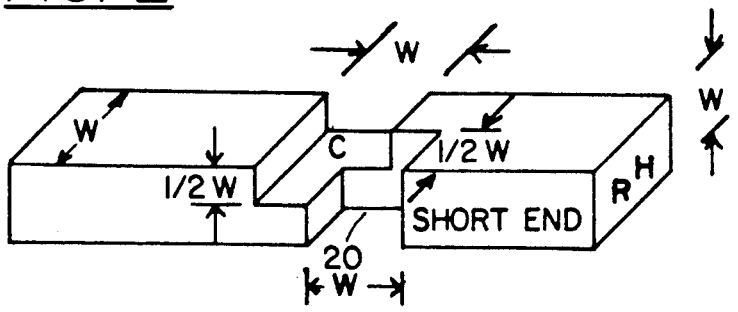
FIG. 2 is a perspective view illustrating the configuration of the right-hand pieces of the present invention.
Figure 3:
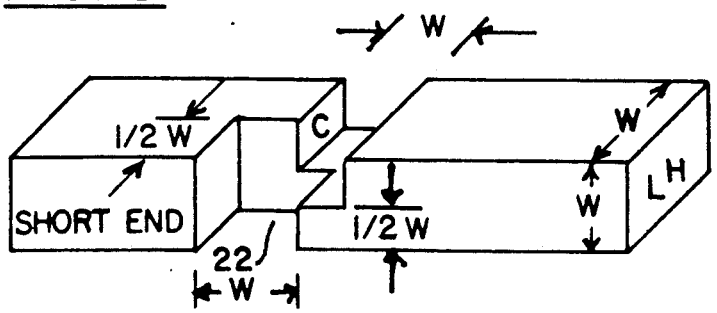
FIG. 3 is a perspective view illustrating the configuration of the left-hand pieces of the present invention.

As illustrated in FIG. 1, a first preferred embodiment of the present invention is comprised of six individual pieces, 24, 26, 28, 30, 32 and 34. Pieces 24, 32 and 34 are identically cut as illustrated in FIG. 2, and pieces 30, 26 and 28 are identically cut as the mirror image of pieces 24, 32 and 34, as illustrated in FIG. 3. Therefore, any one of pieces 24, 32 and 34 can be substituted for any of the other pieces 24, 32 and 34, and any of the pieces 30, 26 and 28 can be substituted for any of the other pieces 30–34. The configuration as illustrated in FIG. 1 is, therefore, exemplary of one final assembly. The same final assembly can obviously, therefore, be arrived at in any one of thirty-six different ways.

Figure 8:
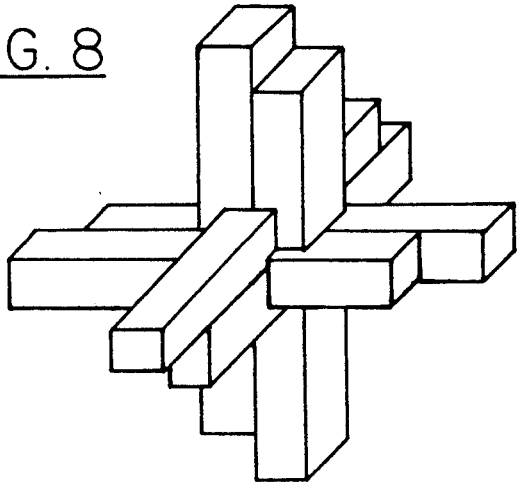
FIG. 8 illustrates an alternative final configuration for the present invention.

The final geometrical FIG. 12, is comprised of three axes: the vertical 14, and the two horizontal 16 and 18. Each axis is comprised of a left-hand component and a right-hand component. As illustrated, axis 14 is comprised of components 28 and 34, axis 16 of 26 and 32, and axis 18 of 24 and 30. The components can be paired in a wide variety of ways, as long as each component is paired with one from the opposite set, to comprise an axis. In the preferred embodiment, illustrated in FIG. 1, where the component ends are aligned, the short end of each piece is matched with the long end of its tandem piece. However, in an alternate configuration with misaligned ends, as illustrated in FIG. 8, the two short ends are coincident, and the two long ends are coincident.

As can be seen in FIGS. 2 and 3, each component has a central notch marked "C" and an off-centered notch identified as 20 on the right-hand piece and 22 on the left-hand piece. That end of the component which contains the secondary notch 20 or 22, therefore, becomes the short end of the component. Centering of the first notch and off-centering of the secondary notch allows for alternative final three-dimensional configurations, as illustrated in FIGS. 1 and 8. There are three left-hand and three right-hand pieces utilized to form the geometric figures shown.

The arrangement of notches in FIG. 2 is a mirror image of the arrangement of notches in FIG. 3. As shown in FIGS. 2 and 3, the notches with a width W and a depth of ½ W, and each piece is square and has a width W on each side.

Figure 4:
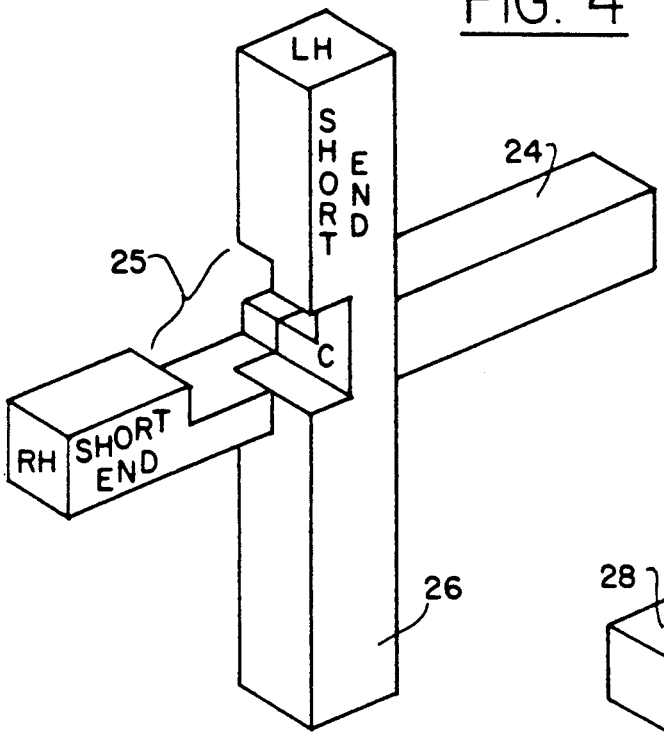
FIG. 4 is a assembly view illustrating the first step in assembling the first half of the present invention.

FIG. 4 illustrates the first step in the construction of the three-dimensional figure. The long end of a left-hand block 26 is inserted into the central notch of a right-hand block 24, so that the central notch of the left-hand block 26 and the offset notch of the right-hand block 24 form a common square opening 25 to allow passage of a further component.

Figure 5:
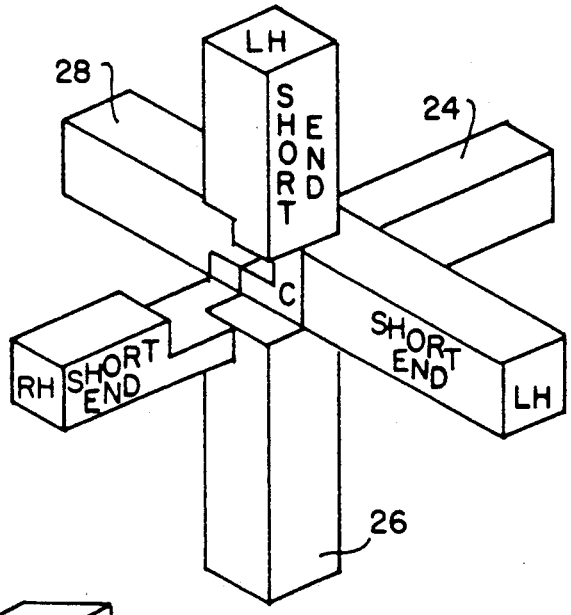
FIG. 5 illustrates the attachment of the third member of the first half of the present invention.

As illustrated in FIG. 5, a second left-hand block 28 is placed in contact with right-hand block 24 and left-hand block 26. The central notch of component 28 engages the long end of component 24, and the offset notch of component 28 engages the short end of component 26, in the manner illustrated in FIG. 5.

Figure 6:
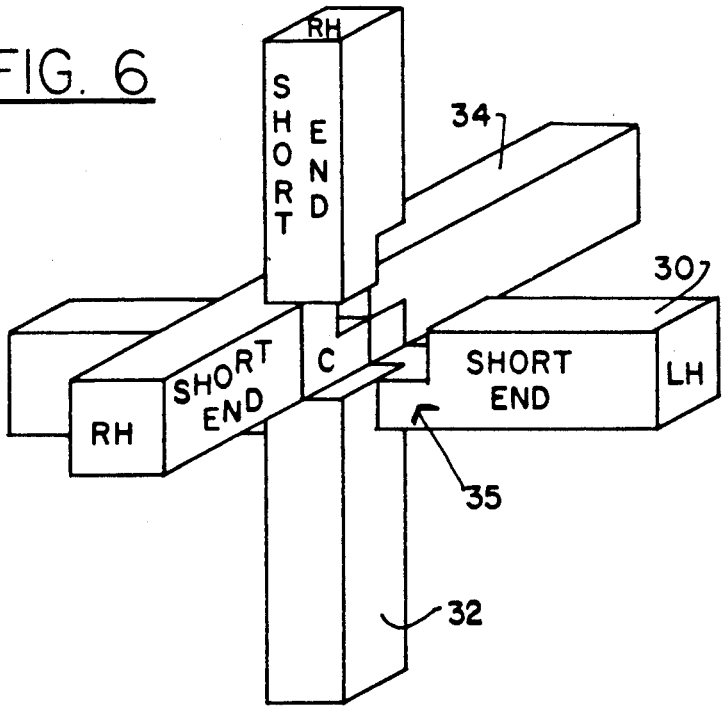
FIG. 6 illustrates the assembly of the second half of the present invention.

The second half of the final three-dimensional figure is formed, as illustrated in FIG. 6, from component members 30, 32 and 34. The second half is a mirror image of the first half, built in the same manner as the first half. Member 32 is placed in the central notch of member 30, such that the central notch of member 32 and the offset notch of member 30 form a common opening 35 to accommodate a further component. Member 34 is then placed in interengaging relationship with members 30 and 32, such that the central notch of member 34 engages the long end of member 30, and the offset notch of member 34 engages the short end of member 32, as illustrated.

Figure 7:
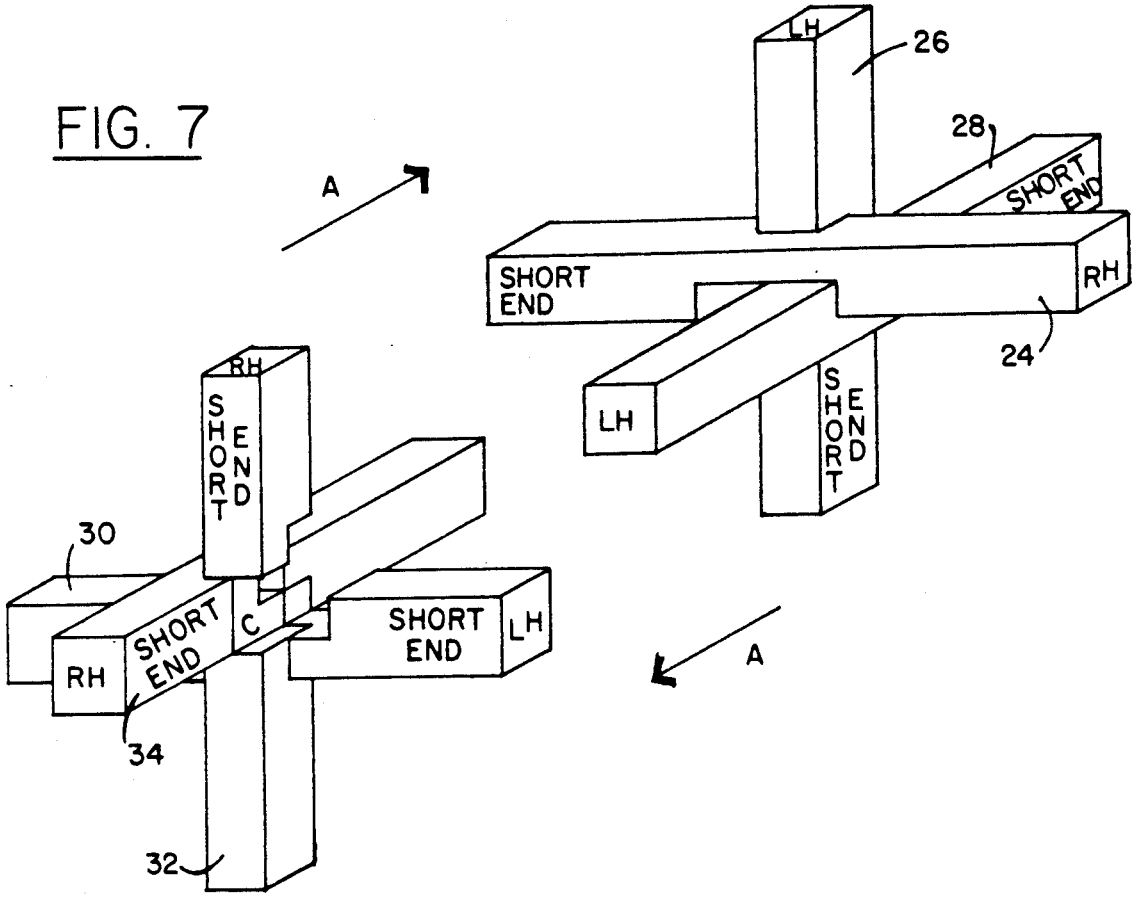
FIG. 7 is a perspective assembly view illustrating the interlocking of the final two halves of the present invention.

The two halves of the double cross are formed at this point, and are then joined, as illustrated in FIG. 7, to form the complete three-dimensional burr. Component 34 of the second half is inserted into the common opening 25 of the first half, and component 28 of the first half is inserted into the common opening 35 of the second half. The two mirror image halves are slid together, as illustrated by arrows A in FIG. 7, in order to form the final geometric configuration.

As can therefore be seen, the puzzle of the present invention relies upon the interengagement of two halves to form the puzzle key in the manner above illustrated. No single piece can be removed from the final three-dimensional figure to act as a key therefore. The secret of disassembly/assembly is the initial breaking of the three-dimensional figure into two mirror image halves.

If the two halves are assembled by substituting offset notches for center notches and vice versa, the final puzzle figure illustrated in FIG. 8 can be formed. This embodiment utilizes the same six components 24, 26, 28, 30, 32 and 34 to form the geometric structure of FIG. 1. The short and long ends of the components, however, have been alternated. As in the case of FIGS. 1 and 7, the arrangement of notches, in each of the two halves of FIG. 8, are mirror images of each other.

Once given the above disclosure, many other features, modifications and improvements will become apparent to the skilled artisan. Such features, modifications and improvements are thus to be considered a part of this invention, the scope of which is to be determined by the following claims:

I claim:

1. A six piece burr puzzle, comprising:

a first group of three pieces, each said piece being an elongated element of square cross-section and having first, second, third and fourth side walls of a width W, each piece having a first notch, of a depth of ½W and a width W, that extends transversely clear across said first side wall, and a second notch of a depth of ½W and a width W, that extends clear across a second said side wall that is perpendicular to said first side wall, said notches overlapping each other and the arrangement of notches in each of said three pieces being identical to the arrangement of notches in each of the other of said three pieces, a second group of three pieces each of which has an arrangement of notches that is a mirror image of the arrangement of notches in any one of the pieces of said first group of pieces, said burr having a first set of three assembled pieces, one from said first group and two from said second group, with said three pieces of said first set respectively extending substantially along three axes each of which is perpendicular to the other two, a second set of three assembled pieces, two of which are from said first group and one of which is from said second group, said three assembled pieces of said first set having its notches positioned to form a mirror image of the notches of said three assembled pieces of said second set, said first and second sets interlocking with each other to form said six piece burr as an integral unit, with two voids and otherwise with all zones of intersection filled.

2. A six piece burr puzzle as defined in claim 1, in which one of the notches in each of the six pieces is a central notch.

3. A six piece burr puzzle as defined in claim 1, in which each of the six pieces has two ends and is of the same length as the other pieces, there being two pieces along each axis, of said three axes, each end of each piece along each axis being in the same plane as an end of the other piece that is along such axis.

4. A six piece burr puzzle as defined in claim 1, in which each of the six pieces has two ends and is of the same length as the other pieces, there being two pieces along each axis, of said three axes, the ends of each piece that is along any given axis being in different planes than the planes in which the ends of the other piece that is along such given axis are located.

5. The method of making a six piece burr puzzle, comprising:

providing a first group of three identical elongated pieces, each of which is an elongated element of square cross-section and having first, second, third and fourth side walls of a width W, providing a center notch, in each of said three pieces, having a depth of ½W and a width of W and extending clear across a side wall of the piece, providing an off-center notch, in each of said three pieces, having a depth of ½W and a width W and extending clear across a side wall that is perpendicular to the side wall that has the center notch, providing a second group of three identical elongated pieces having a square cross section and side walls of a width W, providing center and off-center notches, in each piece of the second group, that are mirror images of the notches of the pieces of said first group, assembling a first set of three pieces two of which are from the first group and one of which is from the second group, assembling a second set of three pieces, one of which is from the first group and the other two are from the second group, said assembly steps being carried out so that the aggregate notch arrangement in said first group is the mirror image of the aggregate notch arrangement in said second set, and fitting the two sets of pieces together, while each set is in the form of an assembled unit, to form a six piece burr with the two notch arrangements, in the two sets respectively being mirror image of each other.

* * * * *